US010179400B2

(12) United States Patent
Furusawa et al.

(10) Patent No.: US 10,179,400 B2
(45) Date of Patent: Jan. 15, 2019

(54) POWER TOOL

(71) Applicant: MAKITA CORPORATION, Anjo-shi, Aichi (JP)

(72) Inventors: Masanori Furusawa, Anjo (JP); Kei Watanabe, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 568 days.

(21) Appl. No.: 14/936,154

(22) Filed: Nov. 9, 2015

(65) Prior Publication Data

US 2016/0136801 A1 May 19, 2016

(30) Foreign Application Priority Data

Nov. 14, 2014 (JP) ..... 2014-231604

(51) Int. Cl.
*B25F 5/02* (2006.01)
*B25D 17/24* (2006.01)
*B25F 5/00* (2006.01)

(52) U.S. Cl.
CPC ..... *B25F 5/026* (2013.01); *B25D 17/24* (2013.01); *B25F 5/006* (2013.01); *B25D 2250/121* (2013.01)

(58) Field of Classification Search
CPC .... B25F 5/00; B25F 5/02; B25F 5/025; B25F 5/026; B25F 5/027; B25F 5/006;
(Continued)

(56) References Cited

U.S. PATENT DOCUMENTS 3,440,465 A * 4/1969 Provost, Jr. ..... H02K 7/145 310/230
4,523,116 A * 6/1985 Dibbern, Jr. ..... H01H 9/063 200/8 R
(Continued)

FOREIGN PATENT DOCUMENTS

DE 19525251 C2 11/1999
DE 102006044433 A1 4/2008
(Continued)

OTHER PUBLICATIONS

Jun. 21, 2016 Office Action issued in German Patent Application No. 102015014559.2.

*Primary Examiner* — Jason Daniel Prone
*Assistant Examiner* — Richard Crosby, Jr.
(74) *Attorney, Agent, or Firm* — Oliff PLC

(57) ABSTRACT

A power tool includes a motor, a driving mechanism, a body housing, a handle, and a rear position defining member. The driving mechanism is driven by the motor and configured to drive a tool bit in a longitudinal direction. The body housing houses the motor and the driving mechanism. The handle is connected to the body housing so as to be allowed to move with respect to the body housing between a front position and a rear position in the longitudinal direction, while being biased by a biasing member in the longitudinal direction. The handle includes a handle base and a handle cover. The rear position defining member extends from the body housing to a position between the handle base and the handle cover in the longitudinal direction and is configured to define a rear position of the handle.

20 Claims, 11 Drawing Sheets

(58) Field of Classification Search
CPC .... B25D 17/04; B25D 17/043; B25D 17/046; B25D 17/24; B25D 17/245
See application file for complete search history.

(56) References Cited

U.S. PATENT DOCUMENTS 4,978,877 A * 12/1990 Quirijnen ..... H02K 23/18 310/229
5,692,574 A 12/1997 Terada
5,697,456 A 12/1997 Radle et al.
6,133,665 A * 10/2000 Prell ..... H01R 39/381 310/239
6,213,222 B1 * 4/2001 Banach ..... B25D 16/00 173/1
6,445,097 B1 * 9/2002 Zeiler ..... B25F 5/02 310/71
6,479,918 B1 * 11/2002 Burger ..... H02K 23/18 310/239
6,930,431 B2 * 8/2005 Buck ..... H01H 9/063 310/239
6,998,754 B2 * 2/2006 Nedriga ..... H01R 39/44 310/239
7,190,100 B2 * 3/2007 Riedl ..... H02K 23/18 310/239
7,355,314 B2 * 4/2008 Riedl ..... H02K 23/18 310/239
7,404,781 B2 * 7/2008 Milbourne ..... B23B 45/008 173/178
7,806,198 B2 * 10/2010 Puzio ..... B25B 21/00 173/1
7,876,004 B2 * 1/2011 Kuhnle ..... B25D 17/00 310/241
8,032,990 B2 * 10/2011 Shinma ..... B25D 17/04 16/426
8,196,674 B2 * 6/2012 Ikuta ..... B25D 17/24 173/162.1
8,403,076 B2 * 3/2013 Iwakami ..... B25D 17/043 173/162.1
8,460,153 B2 * 6/2013 Rudolph ..... B25B 21/02 475/290
9,071,119 B2 * 6/2015 Fuchs ..... H02K 5/14
2006/0185865 A1 * 8/2006 Jung ..... B25D 16/006 173/48
2006/0237207 A1 * 10/2006 Britz ..... H01R 31/06 173/217
2009/0266571 A1 10/2009 Baumann et al.
2011/0011609 A1 * 1/2011 Simm ..... B25D 17/04 173/171
2015/0144368 A1 * 5/2015 Machida ..... B25F 5/006 173/162.2
2015/0266176 A1 * 9/2015 Takeuchi ..... B25D 11/00 173/117
2016/0136801 A1 * 5/2016 Furusawa ..... B25F 5/026 173/162.2

FOREIGN PATENT DOCUMENTS

JP 2005-219195 A 8/2005
WO 2007/068535 A2 6/2007
WO 2008/034668 A1 3/2008

* cited by examiner

POWER TOOL

CROSS-REFERENCE TO RELATED APPLICATION

The present application claims priority to Japanese patent application No. 2014-231604 filed on Nov. 14, 2014, the contents of which are incorporated herein by reference in its entirety.

TECHNICAL FIELD

The present invention relates to a power tool for performing an operation on a workpiece.

BACKGROUND ART

PCT International Publication No. WO 2007/068535 discloses a rotary hammer having a drive unit and a transmission unit. This rotary hammer has a housing unit for housing the transmission unit and a housing unit for housing the drive unit. The housing unit for the drive unit is integrally formed with a main handle. The housing unit for the transmission unit and the housing unit for the drive unit are configured to move with respect to each other. The housing unit which is integrally formed with the main handle provided in a rear end region of the rotary hammer extends to a front end region of the rotary hammer, and an auxiliary handle is attached to the front end region of the rotary hammer.

SUMMARY OF THE INVENTION

In the above-described rotary hammer, the housing units are allowed to move with respect to each other via a plurality of guide elements formed on side surfaces of the housing units, so that transmission of vibration to the main handle is prevented. The guide elements are spaced apart from each other in a longitudinal direction of the rotary hammer. Therefore, movement of the housing unit having the main handle and the auxiliary handle is stabilized, but the size of the housing unit integrally formed with the main handle or the size of the rotary hammer is increased. Accordingly, it is an object of the present invention to provide a technique contributing to size reduction of a power tool in which a handle is movable with respect to a body.

The above-described problem is solved by the present invention. According to a preferred aspect of the present invention, there is provided a power tool that is configured to perform an operation by driving a tool bit in a longitudinal direction of the tool bit. The power tool has a motor, a driving mechanism that is driven by the motor and that is configured to drive the tool bit, a body housing that houses the motor and the driving mechanism, a handle that is connected to the body housing so as to be allowed to move with respect to the body housing, and a biasing member disposed between the body housing and the handle. The handle is biased by the biasing member in the longitudinal direction of the tool bit. The handle is configured to be allowed to move with respect to the body housing between a front position and a rear position in the longitudinal direction of the tool bit, while being biased by the biasing member. The front position is closer to a tip of the tool bit and the rear position is farther from the tip of the tool bit in the longitudinal direction. By this movement of the handle, transmission of vibration, which is generated in the body housing during operation, to the handle can be reduced.

The handle has a handle base and a handle cover. The handle base is disposed closer to the tip of the tool bit in the longitudinal direction of the tool bit, and the handle cover is connected to the handle base on a side of the handle base opposite to the tip of the tool bit in the longitudinal direction of the tool bit. The handle base and the handle cover may be connected together to form a grip to be held by a user. In other words, the handle base and the handle may each form a part of the grip. Generally, component elements for driving the power tool, such as a switch and a controller, may be disposed inside the handle. Therefore, the handle may be formed by the handle base and the handle cover so as to ensure an arrangement region for the above-described component elements. The handle base may serve as a connecting member to be connected to the body housing, and the handle cover may serve as a protecting member for protecting the above-described component elements from the outside. The handle base and the handle cover may be connected together typically by a threadably engaging means such as a screw and a bolt, or a fixing means such as bonding and welding.

Further, the power tool has a rear position defining member that extends from the body housing to a position between the handle base and the handle cover in the longitudinal direction of the tool bit and that is configured to define a rear position of the handle. The rear position defining member may be formed, for example, by an extending part that extends from the body housing through the handle base in the longitudinal direction of the tool bit, and a stopper that is connected to the extending part. Preferable examples of the stopper may include a threadably engaging means such as a screw, a bolt and a nut, and a retaining ring such as a ring spring. In a case where a screw or bolt is employed as the stopper, a shank of the screw or bolt may be configured as the extending part.

According to the present invention, the rear position defining member is provided that extends to a position between the handle base and the handle cover through the handle base in the longitudinal direction of the tool bit and that is configured to define a rear position of the handle. Specifically, the rear position defining member may be disposed between the handle base and the handle cover which form the grip of the handle. Component elements required for movement of the handle with respect to the body housing can be intensively arranged by disposing the member for defining the position of the handle inside the handle. Further, the handle can slide with respect to the body housing while being biased by the biasing member, so that transmission of vibration, which is generated in the body housing during operation, to the handle can be reduced. As a result, a technique for insulating vibration to the handle and a technique for size reduction can both be realized.

In another aspect of the power tool according to the present invention, the power tool may further include a rotation restricting mechanism that is configured to restrict rotation of the handle around an axis of the tool bit with respect to the body housing. Specifically, the handle may be provided to be allowed to move in the longitudinal direction of the tool bit and not to be allowed to rotate around the axis of the tool bit with respect to the body housing. The rotation restricting mechanism may be formed by the extending part serving as the rear position defining member. The extending part may typically be disposed in a position displaced with respect to the center of rotation of the handle, or at a plurality of positions on a prescribed plane perpendicular to the longitudinal direction of the tool bit. According to this aspect, rotation of the handle around the axis of the tool bit can be restricted, while the handle can move in the longitudinal direction of the tool bit with respect to the body housing. Particularly, during operation, vibration may be generated mainly in the longitudinal direction of the tool bit in the body housing. Therefore, transmission of vibration, which is generated during operation, to the handle can be effectively reduced.

In another aspect of the power tool according to the present invention, the handle base may be configured to cover a part of the body housing. Typically, the handle base may cover a region of the body housing which houses the motor (also referred to as a motor housing). Specifically, the handle base may cover an outer surface of the motor housing around the axis of the tool bit. Further, a guide may be provided between the handle base and the part of the body housing covered by the handle base and may be configured to guide movement of the handle with respect to the body housing. The guide may typically be formed by a plurality of guide elements held by the body housing. Preferably, for example, the handle base may be made of resin, and the guide elements may be formed by metal pins made of a different kind of material from the handle base. The metal pins may be preferably disposed in parallel to the longitudinal direction of the tool bit. According to this aspect, movement of the handle with respect to the body housing can be stabilized by the guide. Particularly, during operation, vibration may be generated mainly in the longitudinal direction of the tool bit in the body housing. Therefore, guiding the handle in the longitudinal direction by the guide pins may effectively reduce transmission of the vibration to the handle.

In another aspect of the power tool according to the present invention, one end of the biasing member may be arranged in contact with the body housing and the other end of the biasing member may be arranged in contact with the handle cover. In this case, the biasing force of the biasing member can act upon the body housing and the handle cover. According to this aspect, the biasing member may be disposed inside the handle, so that the space within the handle can be efficiently utilized.

In another aspect of the power tool according to the present invention, the motor may be arranged such that a rotation axis of an output shaft extends in parallel to the longitudinal direction of the tool bit, and the rear position defining member may be formed by a brush holder that holds a brush of the motor. Specifically, the brush holder may also serve as a stopper that is configured to restrict rearward movement of the handle. Typically, the brush holder may be mounted to the body housing around the rotation axis of the motor so as to be rotatable around the rotation axis. Therefore, the position of the brush can be made appropriate by rotation of the brush holder. Further, preferably, the rear position defining member may be formed not only by the brush holder, but by using together with a stopper including the above-described threadably engaging member or retaining ring. According to this aspect, the brush holder that holds the brush of the motor can be utilized as the rear position defining member, so that the number of parts of the power tool can be reduced.

In another aspect of the power tool according to the present invention, an auxiliary handle mounting part on which an auxiliary handle is mountable may be mounted on the body housing via an elastic member. The auxiliary handle may be removably mounted on the auxiliary handle mounting part. Therefore, the handle may also be referred to as a main handle. The auxiliary handle mounting part may typically be provided on a cylindrical barrel of the body housing. As the elastic member, a rubber member such as an O-ring may suitably be used. According to this aspect, the auxiliary handle may be connected to the body housing via the elastic member, so that transmission of vibration to the auxiliary handle can be reduced.

In another aspect of the power tool according to the present invention, a boss hole may be formed in the extending part, and the stopper may be configured as a screw or a bolt that threadably engages with the boss hole. In another aspect of the power tool according to the present invention, the stopper may be configured as a nut that threadably engages with the extending part. In another aspect of the power tool according to the present invention, the guide may comprise a plurality of guide elements arranged on an outer surface of the body housing, in a plurality of positions around an axis of the tool bit.

The present invention provides a technique contributing to size reduction of a power tool which is adapted to reduce transmission of vibration to a handle.

DETAILED DESCRIPTION OF THE EMBODIMENTS

Figure 1:
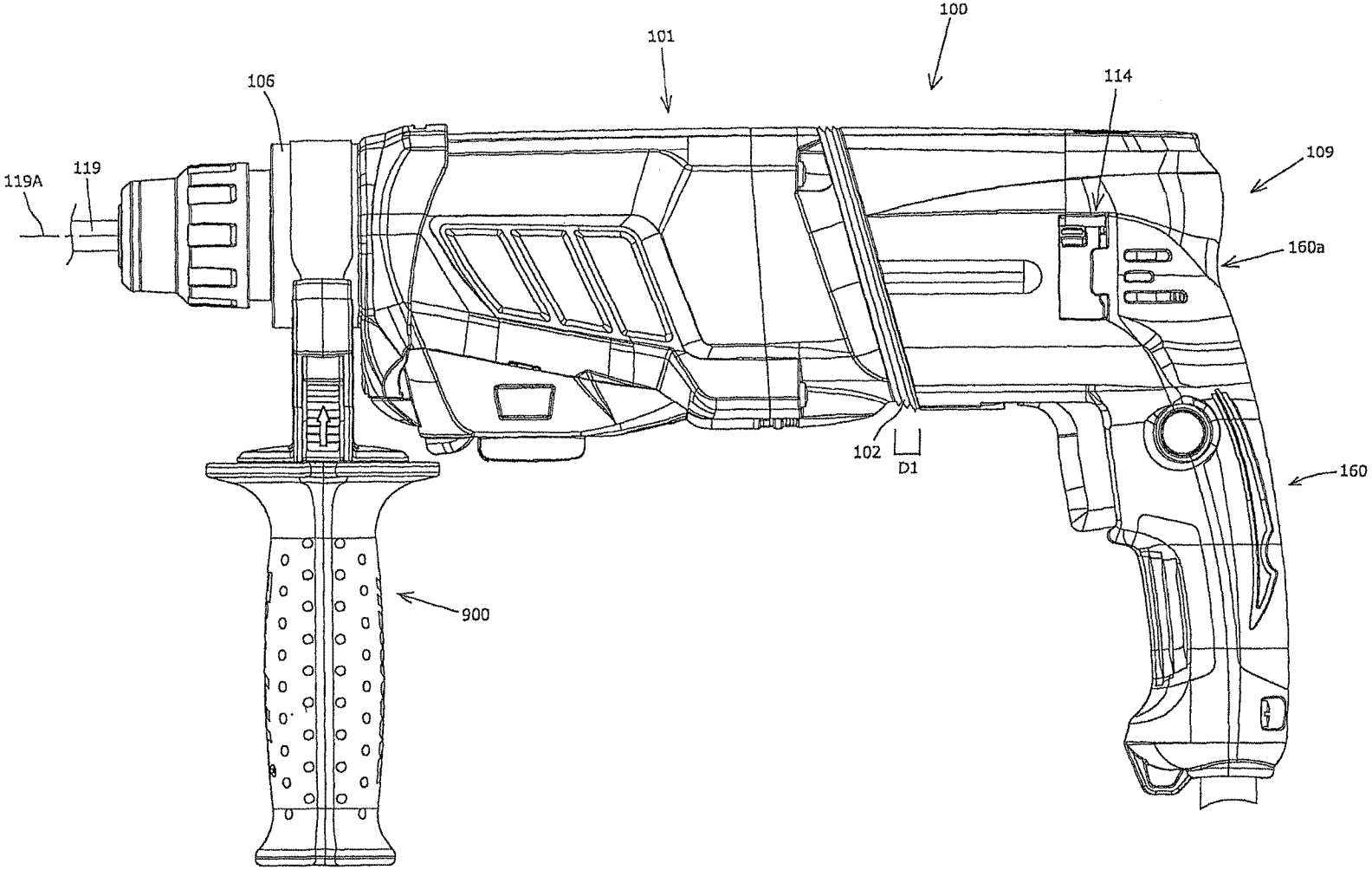
FIG. 1 is a side view showing an overall structure of a hammer drill according to a representative embodiment of the present invention.

A representative embodiment of the present invention is now explained with reference to FIGS. 1 to 11. In this embodiment, a hand-held hammer drill is explained as an example of a power tool. As shown in FIG. 1, a hammer drill 100 is a hand-held power tool that performs a chipping or drilling operation on a workpiece (such as concrete) by causing a hammer bit 119 coupled to a front end region of a body 101 to perform hammering motion in its axial direction (horizontal direction in FIG. 1) and rotating motion around its axis. The hammer bit 119 is an example embodiment that corresponds to the "tool bit" according to the present invention.

(Overall Structure of the Hammer Drill)

Figure 2:
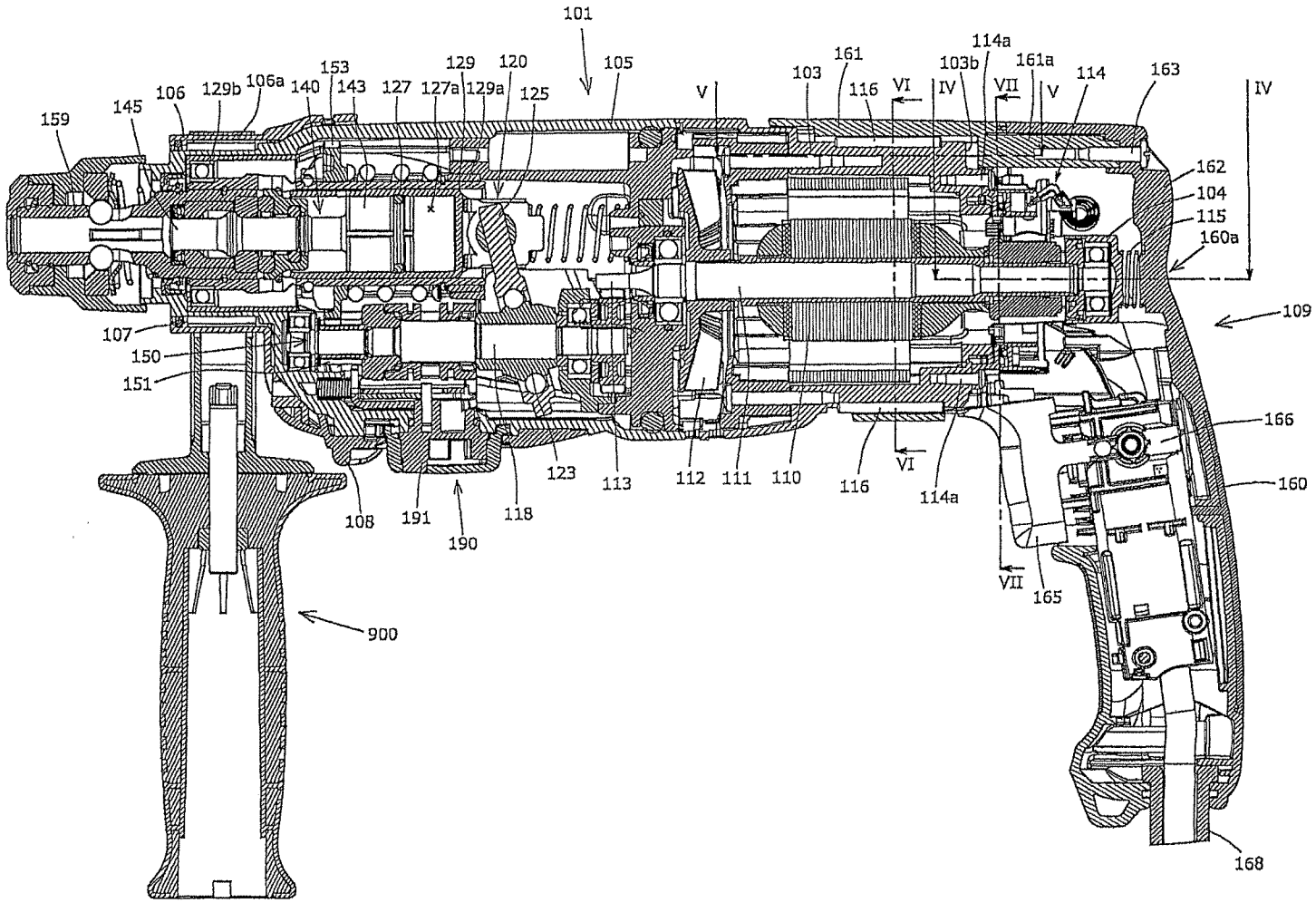
FIG. 2 is a sectional view showing an internal structure of the hammer drill.

As shown in FIGS. 1 and 2, the hammer drill 100 mainly includes a body 101 and a handle 109 that form an outer shell of the hammer drill 100. An auxiliary handle 900 is removably attached to the hammer drill 100. In this embodiment, for the sake of convenience of explanation, a hammer bit 119 side is referred to as a front side and a handle 109 side is referred to as a rear side in the axial direction of the hammer bit 119 (a longitudinal direction of the hammer drill 100, horizontal direction in FIG. 1).

(Body)

The body 101 mainly includes a motor housing 103 and a gear housing 105. The gear housing 105 is disposed in front of the motor housing 103 in the axial direction of the hammer bit 119. The motor housing 103 and the gear housing 105 are fixedly connected to each other by a fastening means such as screws. The motor housing 103 and the gear housing 105 are fixedly connected so as not to be allowed to move with respect to each other, so that a single housing for forming the body 101 is formed. Specifically, the motor housing 103 and the gear housing 105 are formed as separate housings in order to assemble the internal mechanisms, and integrally connected together by the fastening means to form the single housing. The body 101 is an example embodiment that corresponds to the "body housing" according to the present invention.

As shown in FIG. 2, the motor housing 103 houses an electric motor 110. The electric motor 110 is disposed such that an output shaft 111 extends in parallel to the axis of the hammer bit 119. The electric motor 110 is fixed to the motor housing 103 via a baffle plate by a fastening means such as screws. Thus, the output shaft 111 is supported to be rotationally driven. A motor cooling fan 112 is mounted on a front end region of the output shaft 111 and rotates together with the output shaft 111. A pinion gear 113 is provided in front of the fan 112 on the output shaft 111. The electric motor 110 is an example embodiment that corresponds to the "motor" according to the present invention.

Figure 3:
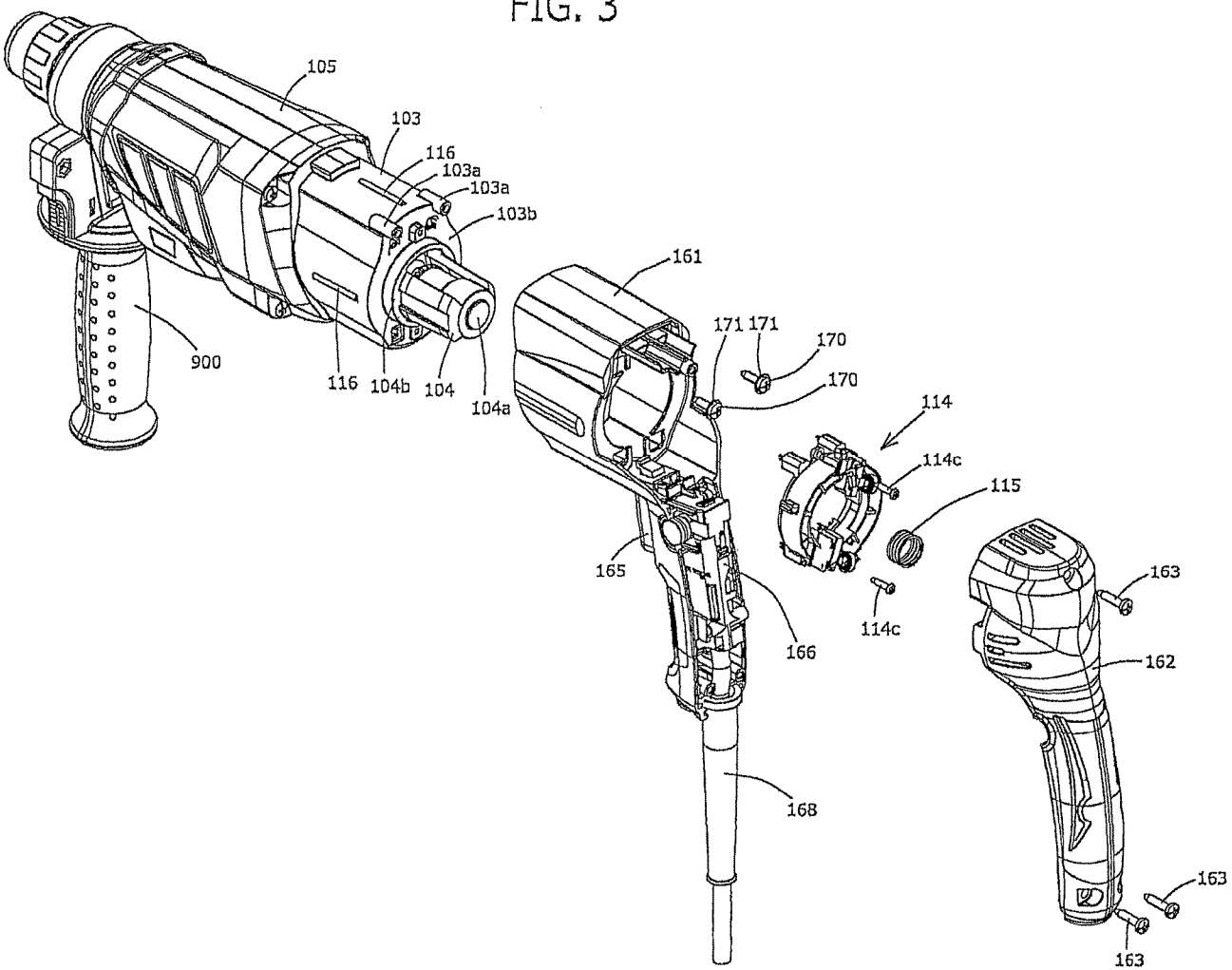
FIG. 3 is an exploded perspective view of the hammer drill.
Figure 7:
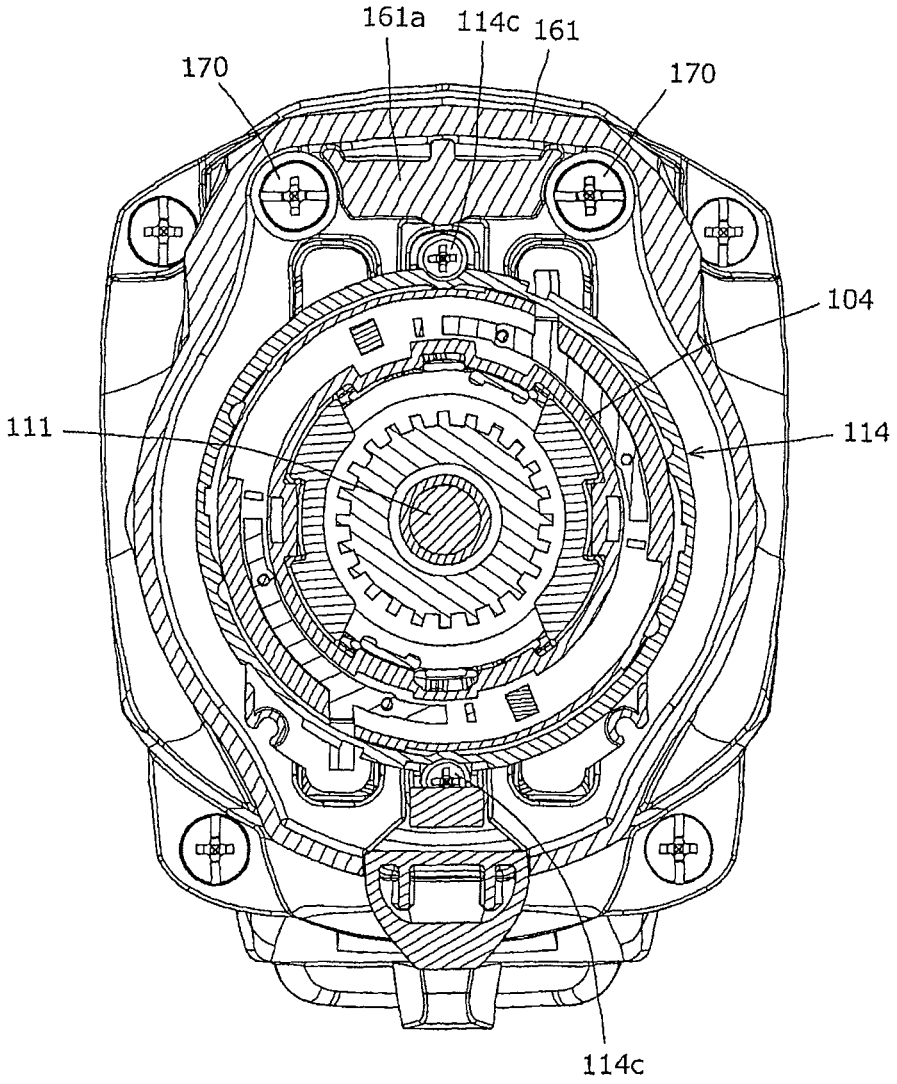
FIG. 7 is a sectional view taken along line VII-VII in FIG. 2.

As shown in FIGS. 2 and 3, the motor housing 103 has a cylindrical bearing holding part 104 for holding a bearing which supports a rear end part of the output shaft 111. The bearing holding part 104 is formed to protrude rearward from a motor housing rear surface 103*b*. A brush unit 114 is fitted onto an outer periphery of the bearing holding part 104 and serves to hold a brush and switch the position of the brush with respect to a commutator. The brush unit 114 is allowed to rotate around the output shaft 111 (the bearing holding part 104). By turning the brush unit 114 to a prescribed position by a user, as shown in FIG. 7, the rotating direction of the electric motor 110 can be switched and the position of the brush can be optimized with respect to the commutator in the switched rotating direction. The brush unit 114 is an example embodiment that corresponds to the "brush holder" according to the present invention.

As shown in FIG. 2, the gear housing 105 houses a motion converting mechanism 120, a striking mechanism 140, a rotation transmitting mechanism 150 and a tool holder 159. The rotation output of the electric motor 110 is converted into linear motion by the motion converting mechanism 120 and then transmitted to the striking mechanism 140. As a result, the hammer bit 119 held by the tool holder 159 is linearly driven in the axial direction via the striking mechanism 140. By the driving of the hammer bit 119 in the axial direction, the hammer bit 119 performs a hammering operation on a workpiece. Further, the speed of the rotation output of the electric motor 110 is reduced by the rotation transmitting mechanism 150 and then transmitted to the hammer bit 119. As a result, the hammer bit 119 is rotationally driven around its axis in the circumferential direction. By the rotational driving of the hammer bit 119, the hammer bit 119 performs a drilling operation on the workpiece. The rotation output of the electric motor 110 is transmitted to the motion converting mechanism 120 and the rotation transmitting mechanism 150 via an intermediate shaft 118 supported by the gear housing 105. The motion converting mechanism 120 and the striking mechanism 140 are example embodiments that correspond to the "driving mechanism" according to the present invention.

As shown in FIG. 2, the motion converting mechanism 120 mainly includes a rotary body 123 fitted on the intermediate shaft 118, a swinging shaft 125 mounted on the rotary body 123, a piston 127 connected to a front end part of the swinging shaft 125, and a cylinder 129 which forms a rear region of the tool holder 159 and houses the piston 127.

The intermediate shaft 118 is engaged with the output shaft 111 of the electric motor 110 and rotationally driven. The rotary body 123 is caused to rotate by rotation of the intermediate shaft 118. By the rotation of the rotary body 123, the swinging shaft 125 is caused to swing in the front-rear direction (horizontal direction in FIG. 2) of the hammer drill 100. Then the piston 127 is caused to reciprocate within the cylinder 129 in the longitudinal direction of the hammer drill 100.

As shown in FIG. 2, the striking mechanism 140 mainly includes a striking element in the form of a striker 143 which is slidably disposed within the piston 127, and an impact bolt 145 which is disposed in front of the striker 143 and with which the striker 143 collides. Further, a space behind the striker 143 within the piston 127 is defined as an air chamber 127*a* which functions as an air spring.

When the piston 127 is moved in the front-rear direction by swinging of the swinging shaft 125, air pressure within the air chamber 127*a* fluctuates, so that the striker 143 is caused to slide within the piston 127 in the front-rear direction of the hammer drill 100 by the action of the air spring. When the striker 143 is moved forward, the striker 143 collides with the impact bolt 145, and the impact bolt 145 then collides with the hammer bit 119 held by the tool holder 159. Thus, the hammer bit 119 is linearly driven forward and thereby performs a hammering operation on the workpiece.

As shown in FIG. 2, the tool holder 159 is generally cylindrical and coaxially and integrally connected to the cylinder 129. The tool holder 159 and the cylinder 129 are supported with respect to the gear housing 105 by bearings 129*a*, 129*b* so as to be allowed to rotate around the axis of the hammer bit 119.

As shown in FIG. 2, the rotation transmitting mechanism 150 mainly includes a gear speed reduction mechanism which is formed by a plurality of gears including a first gear 151 disposed on the intermediate shaft 118 and a second gear 153 engaged with the first gear 151. The second gear 153 is mounted on the cylinder 129 and transmits rotation of the first gear 151 to the cylinder 129. When the cylinder 129 is rotated, the tool holder 159 integrally connected to the cylinder 129 is rotated, and the hammer bit 119 held by the tool holder 159 is rotationally driven. Specifically, the rotation transmitting mechanism 150 rotationally drives the hammer bit 119 held by the tool holder 159. Thus, the hammer bit 119 performs a drilling operation on the workpiece.

The drive mode of the hammer drill 100 can be switched between a hammer drill mode, a drill mode and a hammer mode. In the hammer drill mode, the hammer bit 119 performs a hammering operation by hammering motion in the axial direction and a drilling operation by rotating motion around its axis, so that a hammer drill operation is performed on the workpiece. In the drill mode, the hammer bit 119 only performs a drilling operation by rotating motion around its axis, and does not perform a hammering operation by hammering motion, so that a drilling operation is performed on the workpiece. In the hammer mode, the hammer bit 119 only performs a hammering operation by hammering motion, and does not perform a drilling operation by rotating motion around its axis, so that a hammering operation is performed on the workpiece. A drive mode switching mechanism 190 is provided to switch the drive mode. The drive mode switching mechanism 190 has a changeover dial 191 on the underside of the gear housing 105. The changeover dial 191 can be operated by the user to switch according to the selected drive mode between rotation transmission and interruption of the rotation transmission from the intermediate shaft 118 to the motion converting mechanism 120 and the rotation transmitting mechanism 150. Further detailed explanation of the drive mode switching mechanism 190 is omitted.

As shown in FIG. 2, an auxiliary handle mounting part 106 on which the auxiliary handle 900 is mountable is provided on a front end part of the gear housing 105. The auxiliary handle mounting part 106 is a generally cylindrical resin member and provided to cover a barrel part formed in the front end part of the gear housing 105. A rear end part of the auxiliary handle mounting part 106 is supported on the gear housing 105, in contact with the gear housing 105, and a front end part of the auxiliary handle mounting part 106 is supported on the gear housing 105 via an O-ring 107. With this structure, a buffer region 106*a* which is spaced from the gear housing 105 is formed between the front end part and the rear end part of the auxiliary handle mounting part 106 in the front-rear direction of the hammer drill 100. Therefore, by elastic deformation of the O-ring 107, transmission of vibration to the auxiliary handle 900 mounted on the auxiliary handle mounting part 106 can be reduced. The O-ring 107 is an example embodiment that corresponds to the "elastic member" according to the present invention.

A protection part 108 is formed on a lower end of the auxiliary handle mounting part 106 and protrudes downward from the hammer drill 100 in front of the changeover dial 191. When the hammer drill 100 is placed, for example, on the ground, the protection part 108 comes into contact with the ground so as to prevent the changeover dial 191 from getting into direct contact with the ground and thereby protect the changeover dial 191.

(Handle)

As shown in FIG. 2, the handle 109 has a grip 160 to be held by a user. The handle 109 is an example embodiment that corresponds to the "handle" according to the present invention. The grip 160 extends in a direction crossing the axial direction of the hammer bit 119 (the front-rear direction of the hammer drill 100) or in a top-bottom direction of the hammer drill 100. The grip 160 is formed in a cantilever shape, and a power cable 168 for supplying current from an external power source to the electric motor 110 is mounted to a distal end part (lower end part) of the grip 160. Further, a trigger 165 for switching on and off the electric motor 110 is provided on the front of the grip 160.

As shown in FIGS. 1 and 2, a recess 160*a* is formed in a rear end part of the handle 109. The recess 160*a* is formed below an axis 119A of the hammer bit 119 in the extending direction of the grip 160 (the top-bottom direction of the hammer drill 100). User can hold the hammer drill 100 in two manners: (1) a first holding manner in which the user holds the grip 160, and (2) a second holding manner in which the user holds a side of the handle 109 with a web part between a thumb and a forefinger of the user on the recess 160*a*. In the second holding manner, due to the structure in which the recess 160*a* is formed below the axis 119A of the hammer bit 119, the operability of the trigger 165 can be improved when the user holds a region close to a hammering (striking) axis (the axis 119A of the hammer bit 119). Specifically, it is preferable for the user to hold the handle 109 on the hammering axis in order to transmit user's pressing force to a workpiece when the user performs an operation while pressing the hammer bit 119 against the workpiece. On the other hand, it is preferable for the user to grip the handle 109 in order to operate the trigger 165 on the cantilever type handle 109. In order to attain the both requirements, the recess 160*a* is formed below the axis 119A of the hammer bit 119. Particularly, by forming the recess 160*a* on a rotation axis of the output shaft 111 of the electric motor 110, which is a heavy member in the hammer drill 100, operation can be performed smoothly. In the second holding manner, the trigger 165 may be operated by a ring finger and a little finger of the user.

As shown in FIGS. 2 and 3, the handle 109 mainly includes a handle front part 161 and a handle rear part 162. The handle front part 161 and the handle rear part 162 are fixedly connected to each other by a screw 163 which extends through the handle rear part 162 and threadably engages with a connecting part 161*a* of the handle front part 161. As a result, the hollow grip 160 is formed. The handle front part 161 and the handle rear part 162 are example embodiments that correspond to the "handle base" and the "handle cover", respectively, according to the present invention. In a hollow region between the handle front part 161 and the handle rear part 162 (an internal space of the grip 160), a trigger switch 166 which is actuated by the trigger 165 is disposed. When the trigger 165 is operated by a user, the trigger switch 166 switches to turn on and off the electric motor 110.

Figure 6:
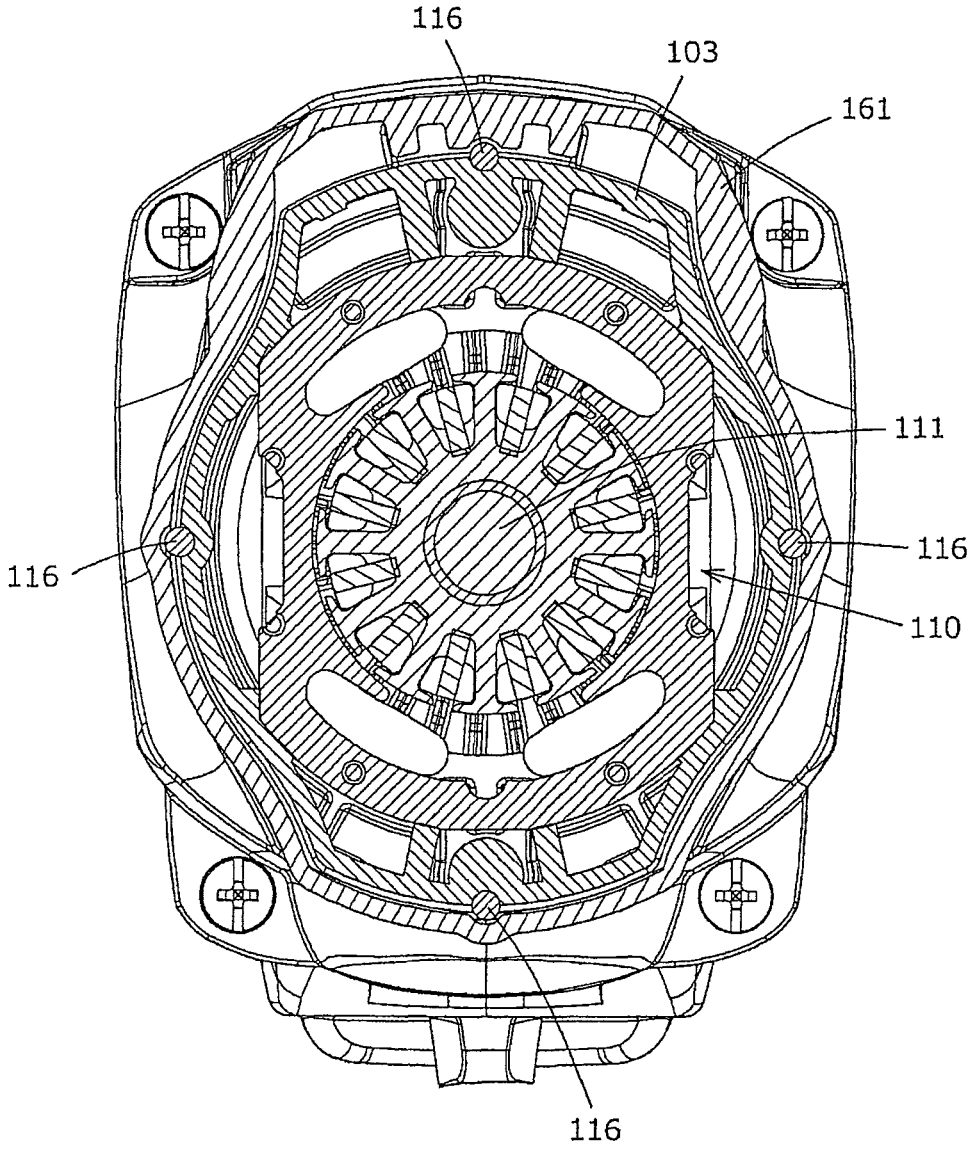
FIG. 6 is a sectional view taken along line VI-VI in FIG. 2.

The handle front part 161 is formed such that its front region covers a rear region of the motor housing 103. As shown in FIGS. 3 and 6, four metal guide pins 116 are held on a surface of the motor housing 103 and extend in the axial direction of the hammer bit 119. The four guide pins 116 are arranged in a balanced manner on an upper end, a lower end, a right end and a left end of the motor housing 103. Guide grooves are formed in an inner surface of the handle front part 161 so as to be engaged with the guide pins 116. Thus, the handle front part 161 is configured to slide in contact with the guide pins 116. Specifically, the handle 109 is movable with respect to the motor housing 103 in the axial direction of the hammer bit 119 (the front-rear direction of the hammer drill 100). The guide pin 116 is an example embodiment that corresponds to the "guide" according to the present invention.

As shown in FIG. 2, the bearing holding part 104 of the motor housing 103 is disposed in the hollow region between the handle front part 161 and the handle rear part 162 behind the handle front part 161. Specifically, the bearing holding part 104 is inserted through the handle front part 161, so that the commutator and the brush unit 114 of the electric motor 110 are disposed in the hollow region of the handle 109. Further, a spring receiving part 104*a* is formed on a rear end of the bearing holding part 104, and a coil spring 115 is disposed between the bearing holding part 104 and the handle rear part 162. Thus, the handle rear part 162 (the handle 109) is biased rearward from the motor housing 103 (the body 101). The coil spring 115 is an example embodiment that corresponds to the "biasing member" according to the present invention.

Figure 4:
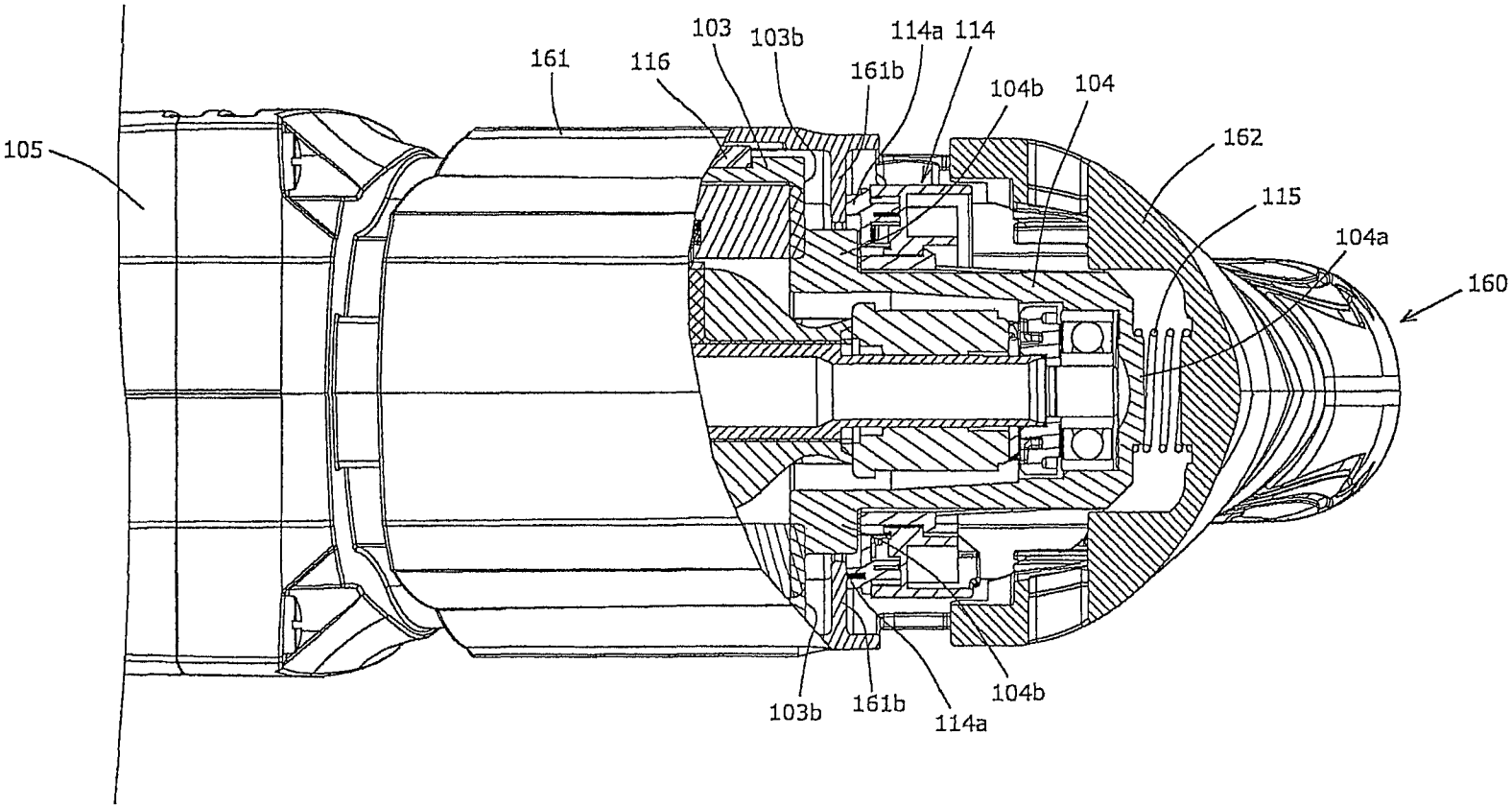
FIG. 4 is a sectional view taken along line IV-IV in FIG. 2.

The brush unit 114 is mounted to the motor housing 103 by screws 114*c* in contact with a shoulder part 104*b* (see FIG. 3) of the bearing holding part 104 which protrudes rearward from the motor housing rear surface 103*b*. Thus, as shown in FIG. 4, the brush unit 114 is arranged apart from the motor housing rear surface 103*b* such that a prescribed space is formed between the brush unit 114 and the motor housing rear surface 103*b*. A flange part 161*b* of the handle front part 161 is arranged in this prescribed space. A contact part 114*a* is formed on the brush unit 114 and protrudes forward. The flange part 161*b* (the handle front part 161) and the contact part 114*a* (the brush unit 114) are held in contact with each other in the state in which the handle 109 is biased rearward from the motor housing 103 by the coil spring 115. In this manner, a rear position of the handle 109 is defined. The brush unit 114 is an example embodiment that corresponds to the "rear position defining member" according to the present invention.

As shown in FIG. 3, two boss parts 103*a* are formed on the motor housing 103 and protrude rearward from the motor housing rear surface 103*b*. The boss parts 103*a* are formed above the axis of the hammer bit 119 in an upper part of the motor housing 103 and extend in parallel to the axial direction of the hammer bit 119. The two boss parts 103*a* are symmetrically arranged with respect to a central plane in the left-right direction of the hammer drill 100 which includes the axis of the hammer bit 119 and the extending axis of the handle 109.

Figure 5:
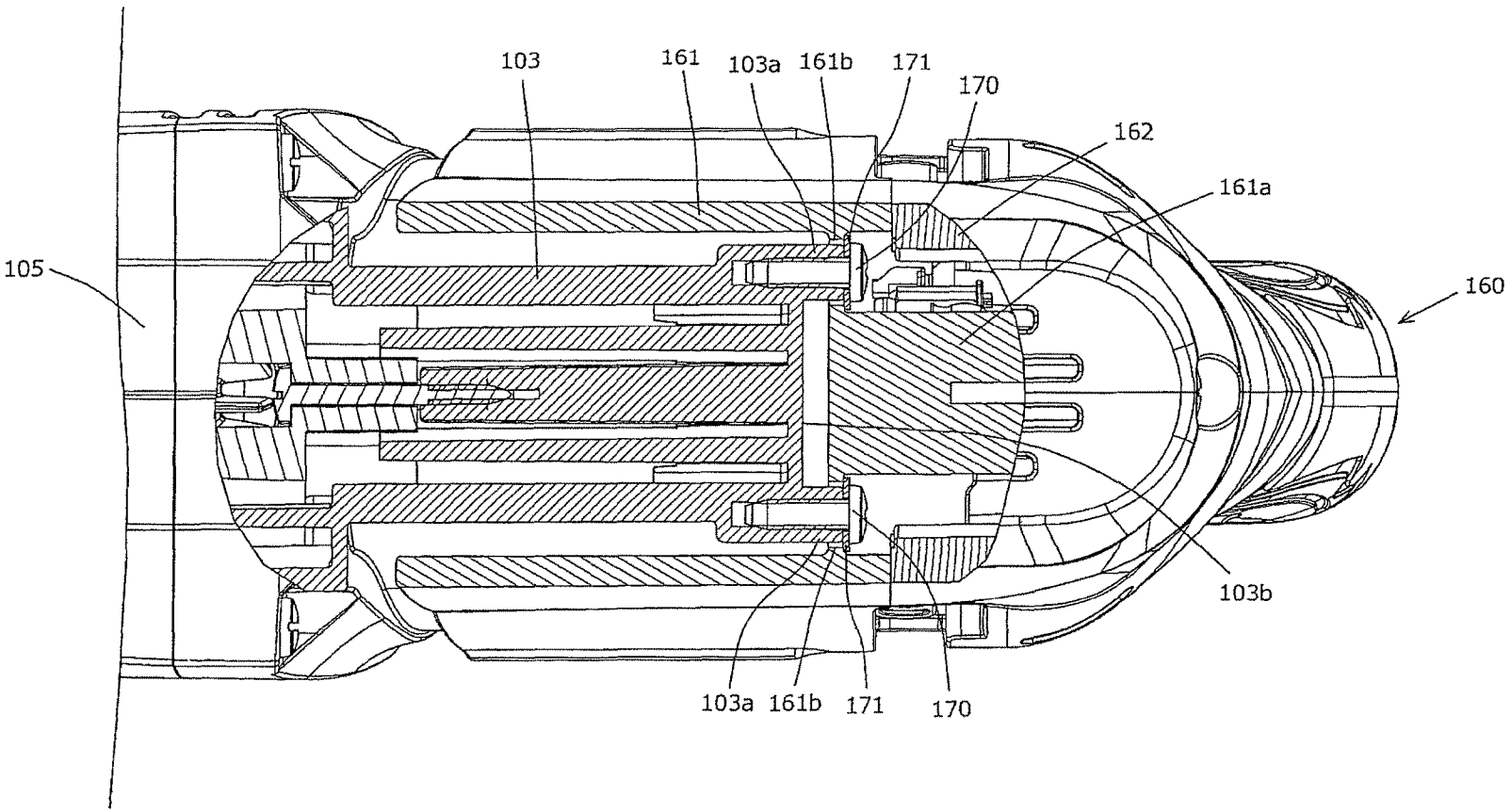
FIG. 5 is a sectional view taken along line V-V in FIG. 2.

As shown in FIG. 5, each of the boss parts 103*a* extends through the flange part 161*b* of the handle front part 161 and a screw 170 is threadably engaged with the boss part 103*a* via a washer 171 from behind the handle front part 161. The boss part 103*a* is an example embodiment that corresponds to the "extending part" according to the present invention. The flange part 161*b* (the handle front part 161) and the washer 171 are held in contact with each other in the state in which the handle 109 is biased rearward from the motor housing 103 by the coil spring 115. In this manner, the rear position of the handle 109 is defined. The washer 171 and the screw 170 are an example embodiment that corresponds to the "rear position defining member" according to the present invention. Further, a front surface of the flange part 161*b* and a front surface of the connecting part 161*a* surfaces on the hammer bit 119 side) form a single plane perpendicular to the axial direction of the hammer bit 119 and facing the motor housing rear surface 103*b*.

After the handle front part 161 is mounted to the motor housing 103 by the screws 170, as shown in FIG. 2, the brush unit 114 is mounted to the motor housing 103 by screws 114*c*. Thereafter, the coil spring 115, the trigger 165 and the trigger switch 166 are disposed between the handle front part 161 and the handle rear part 162. Then the handle rear part 162 is mounted to the handle front part 161 by screws 163. In this manner, the handle 109 is mounted to the body 101 (the motor housing 103).

As shown in FIGS. 4 and 5, the rear position of the handle 109 is defined by contact between the flange part 161*b* of the handle front part 161 and the washer 171 and by contact between the flange part 161*b* of the handle front part 161 and the brush unit 114. Further, the washer 171 may be dispensed with, and in this case, the rear position of the handle 109 may be defined by contact between the flange part 161*b* and a head of the screw 170.

Figure 8:
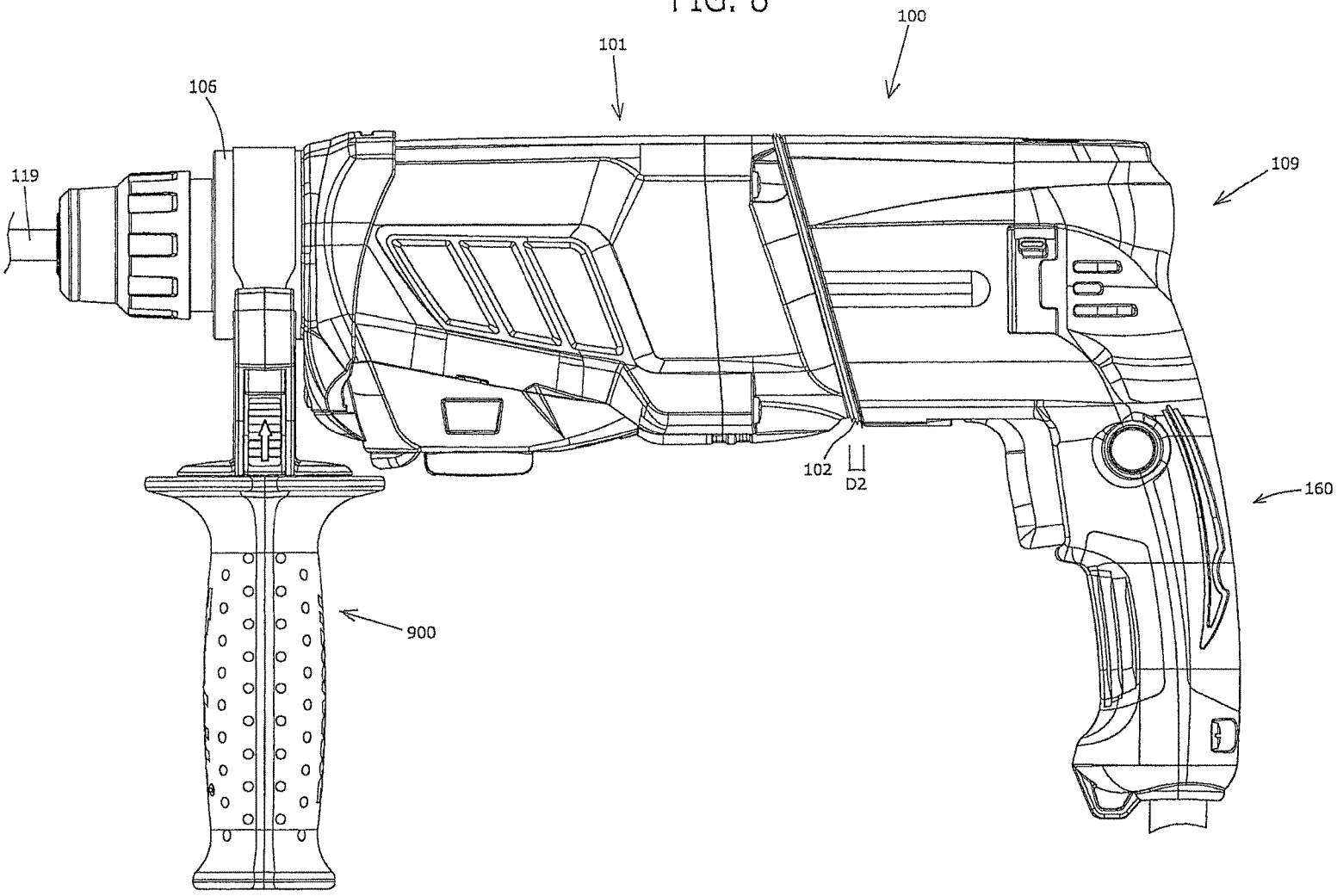
FIG. 8 is a side view showing the hammer drill in FIG. 1 in a state in which the handle is moved forward.

The above-described handle 109 can slide with respect to the body 101 while being biased by the coil spring 115. Specifically, the handle 109 can move between the rear position shown in FIG. 1 and a front position shown in FIG. 8. In the rear position, as shown in FIG. 1, a clearance having a width D1 is formed between the handle 109 and the body 101. In the front position, as shown in FIG. 8, a clearance having a width D2 shorter than the width D1 is formed between the handle 109 and the body 101. Further, as shown in FIGS. 1 and 8, a bellows 102 is provided between the body 101 and the handle 109, so that dust or the like can be prevented from entering between the body 101 and the handle 109.

Figure 9:
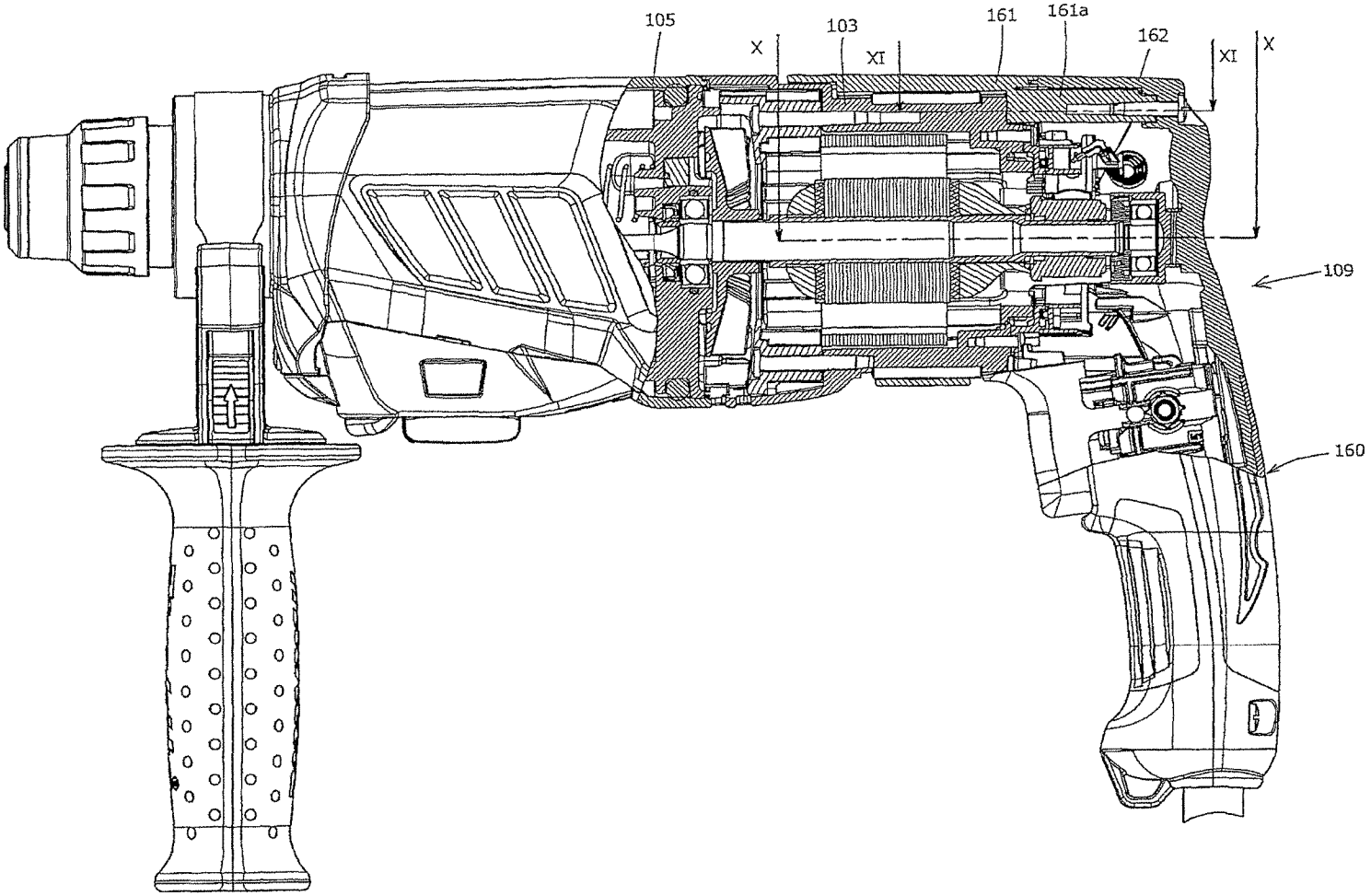
FIG. 9 is a sectional view of the hammer drill in FIG. 8.
Figure 10:
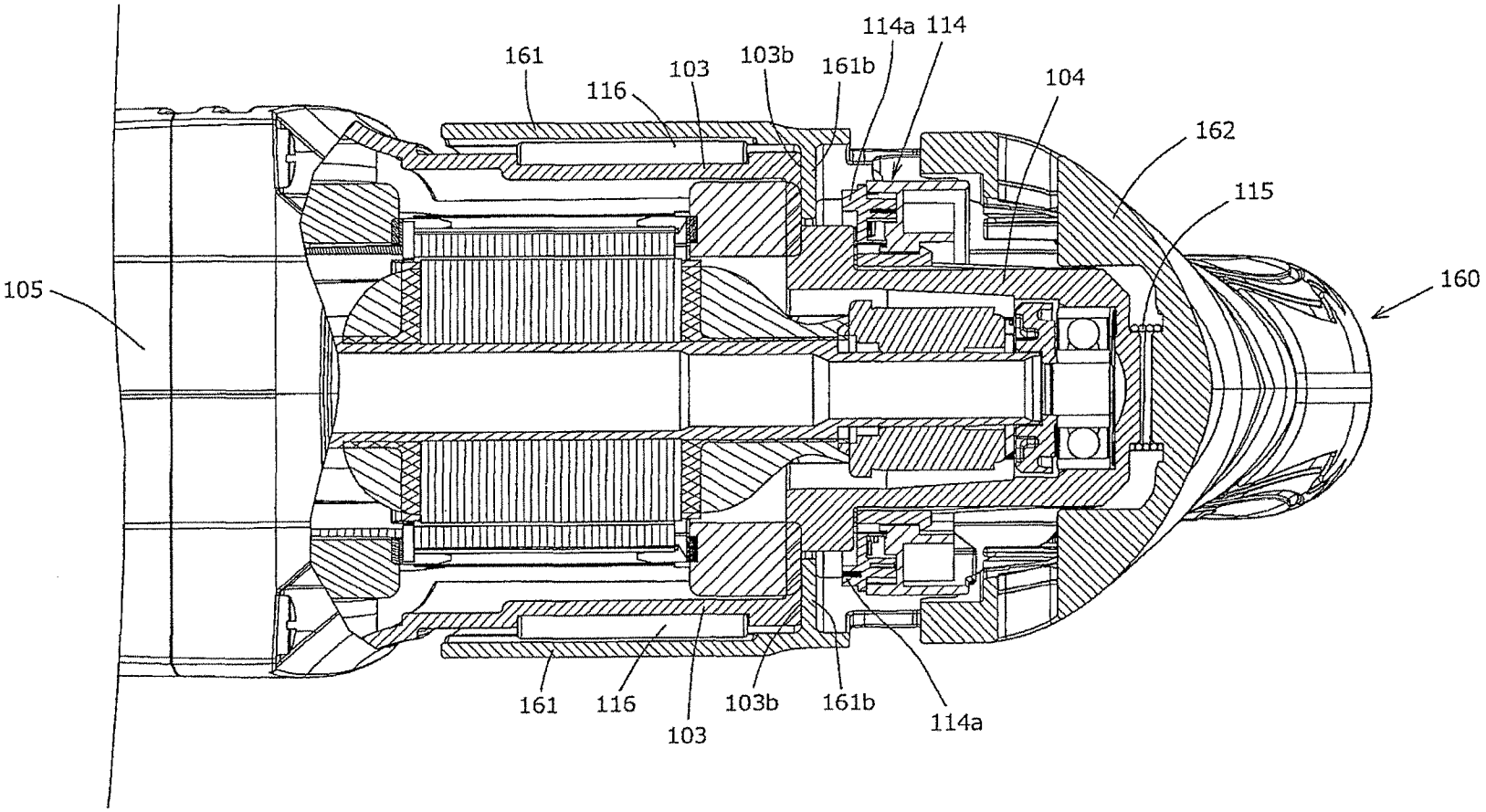
FIG. 10 is a sectional view taken along line X-X in FIG. 9.
Figure 11:
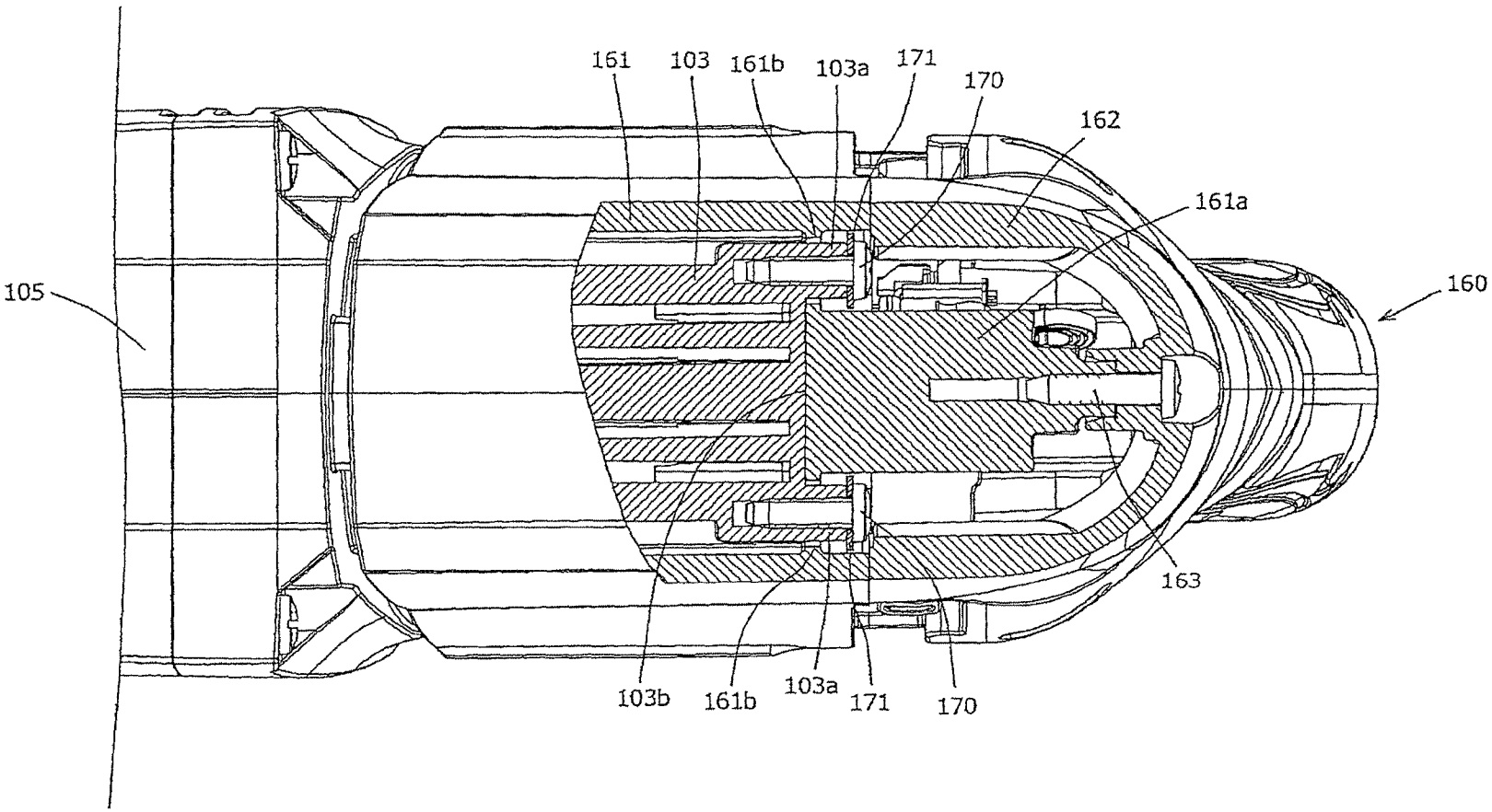
FIG. 11 is a sectional view taken along line XI-XI in FIG. 9.

As shown in FIGS. 9 to 11, when the coil spring 115 is contracted and the handle 109 is located in the front position, the flange part 161*b* and the connecting part 161*a* of the handle front part 161 are each held in contact with the motor housing rear surface 103*b*. Specifically, the front position of the handle 109 is defined by contact between the flange part 161*b* of the handle front part 161 and the motor housing rear surface 103*b* and by contact between the connecting part 161*a* of the handle front part 161 and the motor housing rear surface 103*b*.

In the above-described hammer drill 100, when the trigger 165 is operated, electric current is supplied to the electric motor 110, and the motion converting mechanism 120, the striking mechanism 140 and the rotation transmitting mechanism 150 are driven based on the drive mode selected with the drive mode switching mechanism 190. Then the hammer bit 119 held by the tool holder 159 is driven, so that a prescribed operation is performed. During hammering or hammer drill operation, vibration is generated mainly in the axial direction of the hammer bit 119 in the body 101 by the hammering force of the hammer bit 119 and reaction force from the workpiece. At this time, the handle 109 moves with respect to the body 101 in the axial direction of the hammer bit 119. As a result, the coil spring 115 expands and contracts, so that transmission of vibration from the body 103 to the handle 109 can be reduced.

According to the above-described embodiment, a stopper for defining the rear position of the handle 109 is provided by threadably engaging the screw 170 via the washer 171 with the boss part 103*a* extending to between the handle front part 161 and the handle rear part 162 through the handle front part 161. Specifically, a rear position defining part is provided between the handle front part 161 and the handle rear part 162, which form the grip 160 of the handle 109, in the axial direction of the hammer bit 119. Therefore, the size increase of the handle 109 can be suppressed, so that the hammer drill 100 can be made compact.

Further, according to this embodiment, the handle 109 moves with respect to the body 101 while being biased by the coil spring 115, so that transmission of vibration, which is generated in the body 103 during operation, to the handle 109 can be reduced. As a result, a technique for insulating vibration of the handle and a technique for size reduction can both be realized. The coil spring 115 is disposed within the internal space of the handle 109, so that this internal space can be effectively utilized.

Further, according to this embodiment, not only the washers 171 and the screws 170, but also the brush unit 114 for holding the brush of the electric motor 110 defines the rear position of the handle 109 by contact with the flange part 161*b* of the handle front part 161. Thus, the brush unit 114 does not only serve to hold the brush, but also serves as a stopper.

Further, according to this embodiment, all of the components which form the handle 109 are assembled from behind the body 101. Specifically, the handle 109 can be assembled to the body 101 from one side, so that efficiency in assembling the handle 109 can be improved.

In the above-described embodiment, the rear position defining member for the handle 109 is formed by the boss part 103*a*, the washer 171 and the screw 170, but it is not limited to this example. For example, a male thread may be formed on the outer periphery of the boss part 103*a*, and the boss part 103*a* and a nut which threadably engages with the boss part 103*a* may be provided to form the rear position defining member. In place of the nut which threadably engages with the boss part 103*a*, a ring spring which engages with the boss part 103*a* may be provided. Alternatively, it may be configured such that the boss 103*a* is not provided, but a threadably engaging member such as a screw and a bolt is provided to extend in the axial direction of the hammer bit 119 through the handle front part 161 and threadably engage with the motor housing 103. In this case, a head of the screw or bolt can restrict rearward movement of the handle 109 by contact with the flange part 161*b* of the handle front part 161 and thereby forms the rear position defining member.

In the above-described embodiment, the handgrip 109 is formed in a cantilever shape extending downward from the motor housing 103, but it is not limited to this example. For example, the handgrip 109 may be formed in a loop shape by further connecting the distal end of the handgrip 109 to the motor housing 103.

In the above-described embodiment, the output shaft 111 of the electric motor 110 is arranged in parallel to the axis of the hammer bit 119, but it is not limited to this example. For example, the output shaft 111 of the electric motor 110 may be arranged to cross the axis of the hammer bit 119. In this case, it is preferred that the output shaft 111 is engaged with the intermediate shaft 116 via a bevel gear. It is further preferable that the output shaft 111 is arranged perpendicularly to the axis of the hammer bit 119.

In the above-described embodiment, the power tool is configured as the hammer drill 100, but it is not limited to this example. The power tool may be any power tool in which a tool bit is driven in a prescribed longitudinal direction, such as an electric hammer and a reciprocating saw.

In view of the nature of the above-described invention, the power tool according to the present invention can be provided with the following features. Each of the features can be used separately or in combination with another feature, or in combination with the claimed invention.

(Aspect 1)

A boss hole is formed in the extending part, and the stopper is configured as a screw or a bolt which threadably engages with the boss hole.

(Aspect 2)

The stopper is configured as a nut which threadably engages with the extending part.

(Aspect 3)

The guide comprises a plurality of guide elements arranged on an outer surface of the body housing, in a plurality of positions around the axis.

(Aspect 4)

Two guide elements are symmetrically disposed with respect to a plane including an axis of the tool bit and an extending axis of the handle.

(Aspect 5)

The body housing has a handle base through part which is extends through the handle base, and the biasing member is disposed between the handle base and the handle cover so as to be held between the handle base through part and the handle cover.

(Aspect 6)

The handle base through part is generally cylindrical, and the brush holder is fitted on an outer periphery of the handle base through part such that the handle base through part extends through the brush holder configured as a rear position defining member.

(Correspondences Between the Features of the Embodiment and the Features of the Invention)

The above-described embodiment is merely a representative example for embodying the present invention, and the present invention is not limited to the constructions that have been described as the representative embodiment. Correspondences between the features of the embodiments and the features of the invention are as follow:

The hammer drill 100 is an example embodiment that corresponds to the "power tool" according to the present invention. The body 101 is an example embodiment that corresponds to the "body housing" according to the present invention. The motor housing 103 is an example embodiment that corresponds to the "body housing" according to the present invention. The gear housing 105 is an example embodiment that corresponds to the "body housing" according to the present invention. The boss part 103*a* is an example embodiment that corresponds to the "rear position defining member" according to the present invention. The boss part 103*a* is an example embodiment that corresponds to the "extending part" according to the present invention. The electric motor 110 is an example embodiment that corresponds to the "motor" according to the present invention. The coil spring 115 is an example embodiment that corresponds to the "biasing member" according to the present invention. The motion converting mechanism 120 is an example embodiment that corresponds to the "driving mechanism" according to the present invention. The striking mechanism 140 is an example embodiment that corresponds to the "driving mechanism" according to the present invention. The handle 109 is an example embodiment that corresponds to the "handle" according to the present invention. The handle front part 161 is an example embodiment that corresponds to the "handle" according to the present invention. The handle front part 161 is an example embodiment that corresponds to the "handle base" according to the present invention. The handle rear part 162 is an example embodiment that corresponds to the "handle" according to the present invention. The handle rear part 162 is an example embodiment that corresponds to the "handle cover" according to the present invention. The screw 170 is an example embodiment that corresponds to the "rear position defining member" according to the present invention. The screw 170 is an example embodiment that corresponds to the "stopper" according to the present invention. The washer 171 is an example embodiment that corresponds to the "rear position defining member" according to the present invention. The washer 171 is an example embodiment that corresponds to the "stopper" according to the present invention. The brush unit 114 is an example embodiment that corresponds to the "brush holder" according to the present invention. The guide pin 116 is an example embodiment that corresponds to the "guide" according to the present invention. The auxiliary handle mounting part 106 is an example embodiment that corresponds to the "auxiliary handle mounting part" according to the present invention. The O-ring 107 is an example embodiment that corresponds to the "elastic member" according to the present invention.

DESCRIPTION OF THE NUMERALS

100 hammer drill
101 body
102 bellows

103 motor housing
103*a* boss part
103*b* motor housing rear surface
104 bearing holding part
104*a* spring receiving part
104*b* shoulder part
105 gear housing
106 auxiliary handle mounting part
106*a* buffer region
107 O-ring
108 protection part
109 handle
110 electric motor
111 output shaft
112 fan
113 pinion gear
114 brush unit
114*a* contact part
114*c* screw
115 coil spring
116 guide pin
118 intermediate shaft
119 hammer bit
120 motion converting mechanism
123 rotary body
125 swinging shaft
127 piston
127*a* air chamber
129 cylinder
129*a* bearing
129*b* bearing
140 striking mechanism
143 striker
145 impact bolt
150 rotation transmitting mechanism
151 first gear
153 second gear
159 tool holder
160 grip
161 handle front part
161*a* connecting part
161*b* flange part
162 handle rear part
163 screw
165 trigger
166 trigger switch
168 power cable
190 drive mode switching mechanism
191 changeover dial
900 auxiliary handle

What is claimed is:

1. A power tool that is configured to perform an operation by driving a tool bit in a longitudinal direction of the tool bit, the power tool comprising:

a motor;

a driving mechanism that is driven by the motor and that is configured to drive the tool bit;

a body housing that houses the motor and the driving mechanism; and a handle that is connected to the body housing so as to be allowed to move with respect to the body housing between a front position and a rear position in the longitudinal direction, the front position being closer to a tip of the tool bit and the rear position being farther from the tip, a biasing member that is interposed between the body housing and the handle, and that biases the handle in the longitudinal direction, away from the body housing toward the rear position; and a rear position defining member that is configured to define a rear position of the handle by restricting rearward movement of the handle, wherein:

the handle has a handle base and a handle cover, the handle base being disposed closer to the tip in the longitudinal direction and the handle cover being connected to the handle base on a side of the handle base opposite to the tip in the longitudinal direction, and the rear position defining member extends from the body housing to a position between the handle base and the handle cover in the longitudinal direction, the body housing includes a motor housing that houses the motor, the handle base is configured to cover a part of the motor housing, and the power tool further comprises a guide that is provided between the handle base and the part of the motor housing covered by the handle base, and that is configured to slide relative to the handle base so as to guide movement of the handle with respect to the body housing in the longitudinal direction.

2. The power tool as defined in claim 1, wherein the rear position defining member includes:

an extending part that is connected to the body housing and that extends through the handle base in the longitudinal direction; and a stopper that is connected to the extending part and that comes in contact with the handle so as to restrict rearward movement of the handle.

3. The power tool as defined in claim 2, wherein the extending part is also configured to restrict rotation of the handle around an axis of the tool bit with respect to the body housing.

4. The power tool as defined in claim 1, wherein the handle base is configured to cover a part of the body housing, and a guide is provided between the handle base and the part of the body housing covered by the handle base, the guide being configured to guide movement of the handle with respect to the body housing.

5. The power tool as defined in claim 1, wherein one end of the biasing member is arranged in contact with the body housing, and the other end of the biasing member is arranged in contact with the handle cover.

6. The power tool as defined in claim 1, wherein:

the motor is arranged such that a rotation axis of an output shaft extends in parallel to the longitudinal direction, and the rear position defining member comprises a brush holder that holds a brush of the motor.

7. The power tool as defined in claim 1, wherein an auxiliary handle mounting part on which an auxiliary handle is mountable is mounted on the body housing via an elastic member.

8. The power tool as defined in claim 2, wherein:

a boss hole is formed in the extending part, and the stopper is configured as a screw or a bolt that threadably engages with the boss hole.

9. The power tool as defined in claim 2, wherein the stopper is configured as a nut that threadably engages with the extending part.

10. The power tool as defined in claim 4, wherein the guide comprises a plurality of guide elements arranged on an outer surface of the body housing, in a plurality of positions around an axis of the tool bit.

11. A power tool that is configured to perform an operation by driving a tool bit in a longitudinal direction of the tool bit, the power tool comprising:

a motor;

a driving mechanism that is driven by the motor and that is configured to drive the tool bit;

a body housing that houses the motor and the driving mechanism; and a handle that is connected to the body housing so as to be allowed to move with respect to the body housing between a front position and a rear position in the longitudinal direction, the front position being closer to a tip of the tool bit and the rear position being farther from the tip;

a biasing member that is interposed between the body housing and the handle, and that biases the handle in the longitudinal direction, away from the body housing toward the rear position; and a rear position defining member that is configured to define a rear position of the handle by restricting rearward movement of the handle, wherein:

the handle has a handle base and a handle cover, the handle base being disposed closer to the tip in the longitudinal direction and the handle cover being connected to the handle base on a side of the handle base opposite to the tip in the longitudinal direction, and the rear position defining member includes:

an extending part that is connected to the body housing and that extends in the longitudinal direction through a part of the handle base; and a stopper that is connected to the extending part and that comes in contact with the part of the handle from the rear so as to restrict the rearward movement of the handle.

12. The power tool as defined in claim 11, wherein the rear position defining member includes:

an extending part that is connected to the body housing and that extends through the handle base in the longitudinal direction; and a stopper that is connected to the extending part and that comes in contact with the handle so as to restrict rearward movement of the handle.

13. The power tool as defined in claim 12, further comprising a rotation restricting mechanism that is configured to restrict rotation of the handle around an axis of the tool bit with respect to the body housing, wherein the rotation restricting mechanism comprises the extending part.

14. The power tool as defined in claim 11, wherein the handle base is configured to cover a part of the body housing, and a guide is provided between the handle base and the part of the body housing covered by the handle base, the guide being configured to guide movement of the handle with respect to the body housing.

15. The power tool as defined in claim 11, wherein one end of the biasing member is arranged in contact with the body housing, and the other end of the biasing member is arranged in contact with the handle cover.

16. The power tool as defined in claim 11, wherein:

the motor is arranged such that a rotation axis of an output shaft extends in parallel to the longitudinal direction, and the rear position defining member comprises a brush holder that holds a brush of the motor.

17. The power tool as defined in claim 11, wherein an auxiliary handle mounting part on which an auxiliary handle is mountable is mounted on the body housing via an elastic member.

18. The power tool as defined in claim 12, wherein:

a boss hole is formed in the extending part, and the stopper is configured as a screw or a bolt that threadably engages with the boss hole.

19. The power tool as defined in claim 12, wherein the stopper is configured as a nut that threadably engages with the extending part.

20. The power tool as defined in claim 14, wherein the guide comprises a plurality of guide elements arranged on an outer surface of the body housing, in a plurality of positions around an axis of the tool bit.

* * * * *